US007204209B2

(12) United States Patent
Marin et al.

(10) Patent No.: US 7,204,209 B2
(45) Date of Patent: Apr. 17, 2007

(54) LANCE FOR INJECTING FLUIDS FOR UNIFORM DIFFUSION WITHIN A VOLUME

(75) Inventors: Ovidiu Marin, St. Cloud (FR); Scott Macadam, Laramie, WY (US); Benjamin Bugeat, Madrid (ES); Fabienne Chatel-Pelage, Chicago, IL (US)

(73) Assignee: American Air Liquide, Inc., Houston, TX (US)

( * ) Notice: Subject to any disclaimer, the term of this patent is extended or adjusted under 35 U.S.C. 154(b) by 0 days.

(21) Appl. No.: 11/139,860

(22) Filed: May 27, 2005

(65) Prior Publication Data

US 2005/0263203 A1 Dec. 1, 2005

Related U.S. Application Data

(62) Division of application No. 10/696,575, filed on Oct. 30, 2003, now Pat. No. 6,912,756.

(60) Provisional application No. 60/425,827, filed on Nov. 13, 2002.

(51) Int. Cl.
*F22B 37/48* (2006.01)
*F22B 37/52* (2006.01)

(52) U.S. Cl. ..... 122/405; 122/390; 239/265.19

(58) Field of Classification Search ..... 122/379, 122/390, 405; 15/316.1; 239/290, 296, 239/318, 265.19, 299, 300
See application file for complete search history.

(56) References Cited

U.S. PATENT DOCUMENTS

| | | | | |
|---|---|---|---|---|
| 5,551,354 | A * | 9/1996 | Crofut et al. | 110/238 |
| 5,762,005 | A * | 6/1998 | Parisi et al. | 110/234 |
| 6,334,770 | B1 * | 1/2002 | Giraud et al. | 432/146 |
| 6,513,462 | B1 * | 2/2003 | Shiraishi et al. | 122/382 |
| 6,651,906 | B2 * | 11/2003 | Saidman | 239/290 |
| 6,793,160 | B1 * | 9/2004 | Bailey | 239/548 |
| 2002/0063172 | A1 * | 5/2002 | Shai et al. | 239/553.5 |

* cited by examiner

*Primary Examiner*—Gregory Wilson
(74) *Attorney, Agent, or Firm*—Christopher J. Cronin

(57) ABSTRACT

An injection lance for injecting a fluid over a predefined target area within a system includes a support block with an inlet side and an outlet side. A plurality of channels are disposed non-parallel with respect to each other within the support block and extend between the inlet and outlet sides of the support block so as to receive fluid at the inlet side and deliver fluid through the support block for injection from the outlet side of the support block over the target area. At least two channels extend from the inlet side toward the outlet side in a direction away from a central axis of the support block, where the central axis intersects the outlet side. The target area includes a plurality of consecutively aligned sectors, and the channels are oriented within the support block so that a central axis of a fluid stream injected from each channel over the target area is centered between longitudinal boundaries defined by a respective sector.

2 Claims, 2 Drawing Sheets

LANCE FOR INJECTING FLUIDS FOR UNIFORM DIFFUSION WITHIN A VOLUME

CROSS REFERENCE TO RELATED APPLICATIONS

This application is a divisional of prior application Ser. No. 10/696,575 filed Oct. 30, 2003, now U.S. Pat. No. 6,912,756 and for which a Provisional Patent Application was filed on Nov. 13, 2002, having Application Ser. No. 60/425,827.

BACKGROUND OF THE INVENTION

1. Technical Field

The present invention pertains to injection lances for delivering fluids into high volumes such as boilers.

2. Discussion of the Related Art

Injection lances are utilized in boilers, furnaces and other systems to deliver one or more fluids, typically gases, at selected concentrations and flow rates to one or more selected areas within the system. In particular, injection lances are utilized in boilers to deliver oxygen into the boiler as an oxidant for mixing and reaction with fuels (e.g., coal, natural gas, oil, etc.) disposed and/or flowing within the boiler. In order to ensure a sufficient amount of oxygen is injected within the boiler during system operation, it is often necessary to inject excessive amounts of oxygen from the lance, which results in increased operational costs.

OBJECTS AND SUMMARY OF THE INVENTION

Accordingly, it is an object of the present invention to provide an injection lance that distributes one or more fluids to a selected location or target area within a system volume.

It is another object of the present invention to provide an injection lance that uniformly distributes fluids over the target area within the system volume.

It is a further object of the present invention to ensure substantially complete and uniform diffusion of fluid over the target area within the system volume while minimizing the amount of fluid injected into the system volume.

The aforesaid objects are achieved individually and/or in combination, and it is not intended that the present invention be construed as requiring two or more of the objects to be combined unless expressly required by the claims attached hereto.

According to the present invention, an injection lance for injecting a fluid over a predefined target area within a system includes a support block with an inlet side and an outlet side. A plurality of channels are disposed non-parallel with respect to each other within the support block and extend between the inlet and outlet sides of the support block so as to receive fluid at the inlet side and deliver fluid through the support block for injection from the outlet side of the support block over the target area. At least two channels extend from the inlet side toward the outlet side in a direction away from a central axis of the support block, where the central axis intersects the outlet side. The target area includes a plurality of consecutively aligned sectors, and the channels are oriented within the support block so that a central axis of a fluid stream injected from each channel over the target area is disposed centrally within a respective sector.

Preferably, the channels are suitably dimensioned to facilitate the flow of fluid through each channel such that the ratio of mass flow rate of fluid through each channel satisfies the following equation:

$$m_i=(A_i/A_{tot})*m_{tot}; \quad (1)$$

where $m_i$ is the mass flow rate through each channel; $A_i$ is the area of the sector for a respective channel; $A_{tot}$ is the target area; and $m_{tot}$ is the sum of mass flow rates for each channel.

In another embodiment of the present invention, a method of injecting a fluid into an enclosed volume including a target area includes the steps of partitioning the target area into a plurality of consecutively aligned sectors, and providing a lance to deliver fluid over the target area. The lance includes a support block including an inlet side and an outlet side, and a plurality of injection channels disposed non-parallel to each other within the support block and extending between the inlet and outlet sides, where each injection channel is oriented to deliver a fluid stream into a respective sector.

The lance design and corresponding methods facilitate the injection of one or more fluids at a uniform flow rate into an enclosed volume and over a predefined target area, while minimizing the amount of fluid required to encompass the target area.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
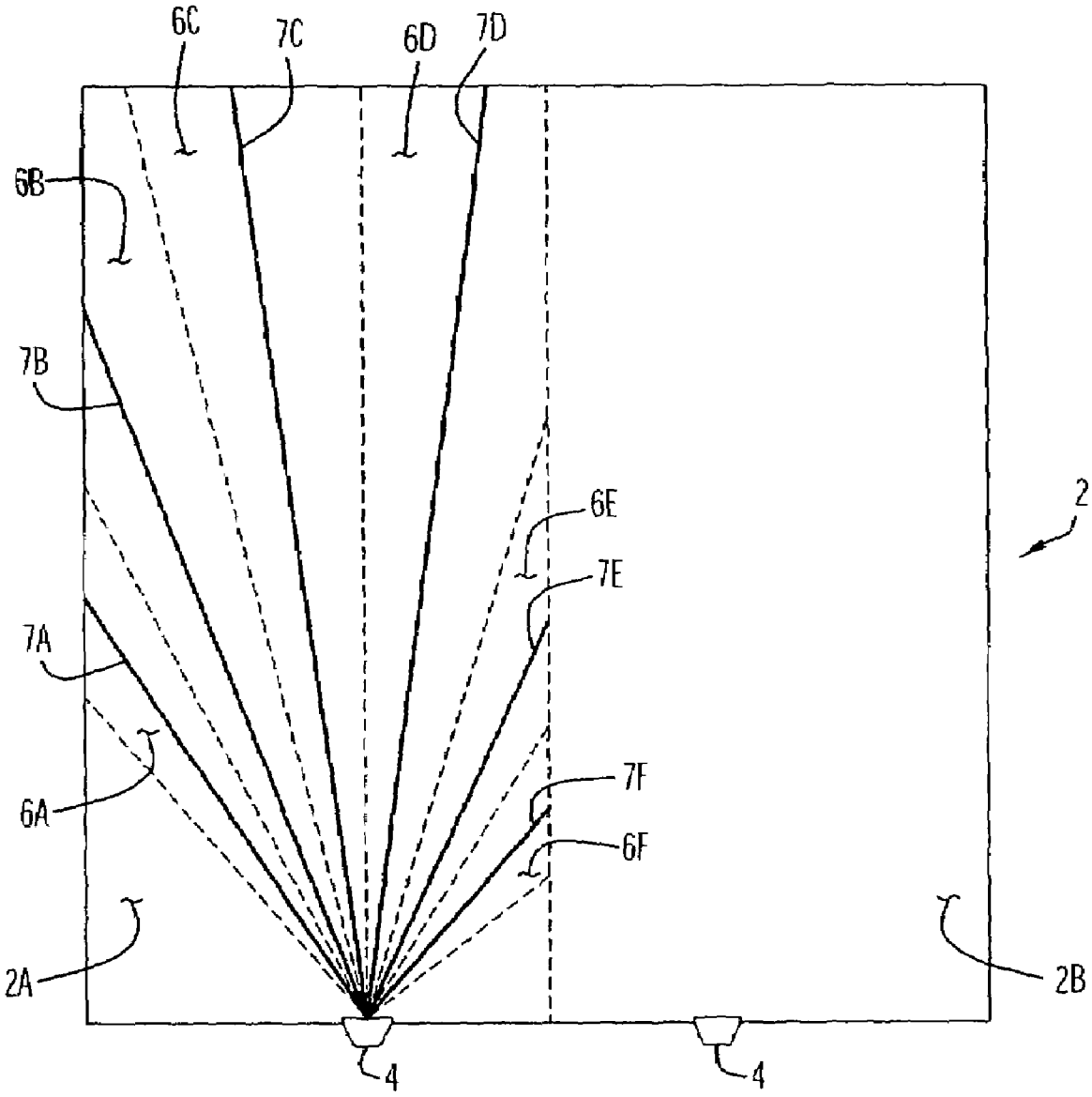
FIG. 1 is a top view in cross-section of a boiler divided into target areas, with sectors partitioned in the target areas, and further utilizing injection lances in accordance with the present invention.

An injection lance in accordance with the present invention includes a plurality of injection ports or channels (i.e., two or more) to deliver one or more fluids into a boiler, furnace or other system for diffusion within a selected or predefined target area of the system. Any suitable number of lances (e.g., one or more) may be utilized with the system, with each lance including a selected number of fluid injection channels extending through the lance between inlet and outlet sides of the lance. The injection channels of the lance are preferably oriented in a non-parallel manner with respect to each other, with two or more channels diverging away from a central portion of the lance as the channels extend from the inlet side to the outlet side of the lance. The orientation of injection channels in this manner facilitates injection of fluid streams from the injection channels into the system in a spread or fan-shaped manner to cover the target area associated with the lance within the system volume. In particular, the lance is designed such that each fluid stream is injected into a partitioned sector of the target area in a manner described below. In addition, the flow rate of fluid through each injection channel is controlled, as described below, so as to achieve a generally uniform diffusion of fluid within the target area while injecting a minimal amount of fluid from the lance.

In boiler applications, it is important to inject a selected amount of oxygen to mix and react with fuel within the boiler during system operation. It is desirable to inject a flow of oxygen from one or more lances in a uniform manner over a selected or predefined target area within the boiler (e.g., over a selected cross-sectional area of the boiler volume) to maximize combustion reactions between the injected oxygen and one or more fuel sources or streams disposed and/or flowing within the boiler. The oxygen is preferably injected in fuel streams that intersect one or more fuel streams so as to facilitate sufficient mixing and reaction of the oxygen with the fuel.

Selection of a suitable number of lances and a specific design for each lance (e.g., the number and dimensions of injection channels and degree to which injection channels are oriented within the lance) for a particular boiler or other system will depend upon the size and geometric configuration of the target area within the system in which a uniform diffusion of fluid is desired. The boiler may include any number of target areas (e.g., one or more), where each target area corresponds to a single injection lance. The target area may be a complete or partial cross-sectional area of the boiler, where the cross-section is planar or nonplanar (e.g., curved, convex, concave, V-shaped, saddle-shaped, zigzagged, etc.)). Preferably, the target area is transverse in orientation to and intersects a fuel supply source and/or stream.

The injection channels are preferably aligned within the lance such that the centers of the injection channel outlets are substantially aligned with and/or slightly offset from the target area. For example, when the target area is planar, the injection channel outlets are preferably aligned along and/or slightly offset (e.g., less than ten centimeters) from a line disposed on the plane that defines the target area. Since the fluid streams expand in three dimensions within the system volume upon emerging from the injection channels, a slight offset in alignment of injection channel outlets from the target area will still result in fluid covering the target area by these injection channels.

Lances may be disposed at any one or more suitable locations along the peripheral walls of the boiler that enclose the boiler volume, with injection channels in each lance being oriented at any one or more selected angles with respect to the inlet and outlet sides of the lance so as to achieve a desired fan-like distribution of fluid streams from the channels into the boiler. For example, injection channels may be oriented at angles ranging from between 0° to about 45° or more with respect to a linear axis extending generally perpendicular to the inlet side and/or outlet side of the lance.

A selected area of the boiler in which fluid is to be injected from one or more lances can be divided into two or more target areas corresponding with two or more lances to be used with the boiler. Alternatively, for certain boiler configurations, the selected area may include a single target area requiring a single lance for injecting gas into the boiler volume.

Upon selection of one or more target areas within the boiler volume, each target area is then partitioned into two or more consecutively aligned sectors, where each sector corresponds with a respective injection channel of a corresponding lance. Specifically, the target area sectors of the boiler and the corresponding lance are configured such that each sector is defined by a narrow portion located adjacent the outlet of a respective injection channel of the lance, with the sector expanding to a wider portion located adjacent a border of the target area. The expanding sector design from each injection channel outlet to a border of the target area simulates a desired jet expansion area to be encompassed by a diffusing fluid stream flowing from the outlet of the corresponding injection channel over the target area of the boiler. Thus, each lance is designed with injection channels suitably oriented within the lance to accommodate flow of fluid streams from the injection channels into respective sectors of the target area when the lance is suitably aligned on the boiler peripheral wall to direct fluid over the target area. Preferably, the injection channels are suitably oriented within the lance such that the central axis of a fluid stream injected from each channel into the boiler volume will be substantially centrally aligned with the respective target area sector.

The degree to which a fluid stream emerging from an injector channel will expand into its respective sector is dependent upon many factors including, without limitation, the velocity of the respective fluid stream emerging from the respective lance outlet, the density and other physical properties of the fluid, the dimensions of the injection channel (e.g., channel length and/or cross-sectional dimensions), the degree to which other streams are flowing in directions transverse the fluid stream, etc. Accordingly, selection of the degree of expansion for sectors in a particular scenario will be based upon the specific boiler system environment. For example, for certain boiler embodiments, sectors can be sized for a target area within the boiler by expanding the longitudinal borders of each sector at an angle of about 10–20° or more from the central axis of the respective injection channel to approximate a jet expansion of the fluid stream emerging from the injection channel over the target area.

Upon establishing one or more target areas with partitioned sectors within a specific boiler volume, the dimensions of the injection channels are selected to achieve a selected flow of fluid, preferably a uniform flow of fluid, over the target area. To achieve an approximate or substantially uniform mass flow distribution of fluid over the target area, the mass flow rate to be provided to each sector is calculated as follows:

$$m_i=(A_i/A_{tot})*m_{tot} \quad (1)$$

where: $m_i$ is the mass flow rate of the ith sector;

$A_i$ is the area of the ith sector;

$A_{tot}$ is the target area associated with a particular lance (i.e., the sum total area for all the sectors); and $m_{tot}$ is the total mass flow rate required for the target area (i.e., the sum total of mass flow rates through each channel).

As can be seen from equation (1), a uniform mass flow rate of fluid can be achieved over the target area when the ratio of $m_i/A_i$ for each sector is the same. The value of mi can be calculated for each sector, utilizing equation (1), after establishing the target area and sectors within the boiler volume, and each injection channel for the lance can be appropriately sized to ensure the calculated mass flow rate of fluid into the respective sector is maintained. When utilizing one or more fluids having the same or similar density under system operating conditions, and when the incoming fluid to each injection channel is at the same or similar velocity, the cross-sectional dimensions of each injection channel should be proportional to the mass flow rate required for the respective sector associated with the channel.

In an exemplary embodiment, injection lances are designed to deliver oxygen to a boiler system 2 having a generally rectangular cross-sectional area, as depicted in FIG. 1, such that the fluids uniformly fill a majority of this boiler area. Oxygen is supplied to each of the injection channels at the same flow rate. Referring to FIG. 1, two lances 4 are provided to deliver multiple streams of gas into the boiler volume. While two lances are depicted, it is noted that any suitable number of lances may be provided (e.g., one or more), where any two or more lances are aligned in any suitable orientation with respect to each other, to facilitate the injection and diffusion of gas over the selected one or more target areas within the boiler volume. The lances may inject fluid streams horizontally and/or vertically within the boiler, preferably in a direction transverse a fuel stream (not shown) so as to intersect the fuel stream and facilitate mixing and reaction of the streams within the boiler.

The two lances 4 are substantially similar in design and are aligned along the same side of boiler 2 a selected distance from each other, and the cross-sectional area of the boiler is divided into two target areas 2A and 2B (separated by a dotted line in FIG. 1) to correspond with each lance. In particular, the lances are oriented so as to deliver fluid streams in a generally horizontal direction into the boiler volume to cover the horizontal cross-sectional target area. However, it is noted that the lances may be oriented in any manner along the boiler periphery to deliver fluid streams at any selected orientation within the boiler volume, depending upon selection of a particular target area. In addition, while target areas 2A and 2B are planar in FIG. 1, other non-planar target areas may also be covered in accordance with the present invention.

Target area 2A includes six consecutively aligned sectors 6A, 6B, 6C, 6D, 6E and 6F (separated by dotted lines in FIG. 1) corresponding with six injection channels disposed on lance 4. The six injection channels of lance 4 deliver fluid streams into the respective sectors. While not depicted in FIG. 1, it is noted that target area 2B contains similar sectors as target area 2A to correspond with a respective lance 4 aligned with this target area.

Figure 2:
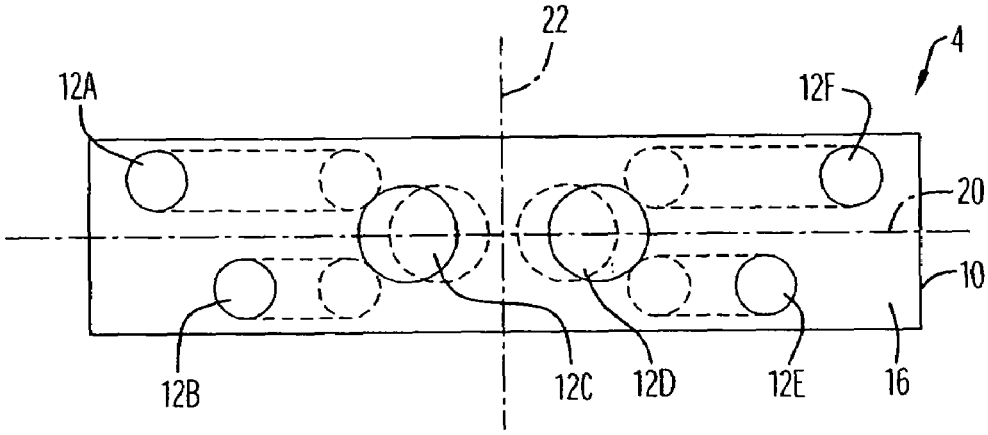
FIG. 2 is a view in elevation and partial section of the outlet end of an injection lance in accordance with the present invention.
Figure 3:
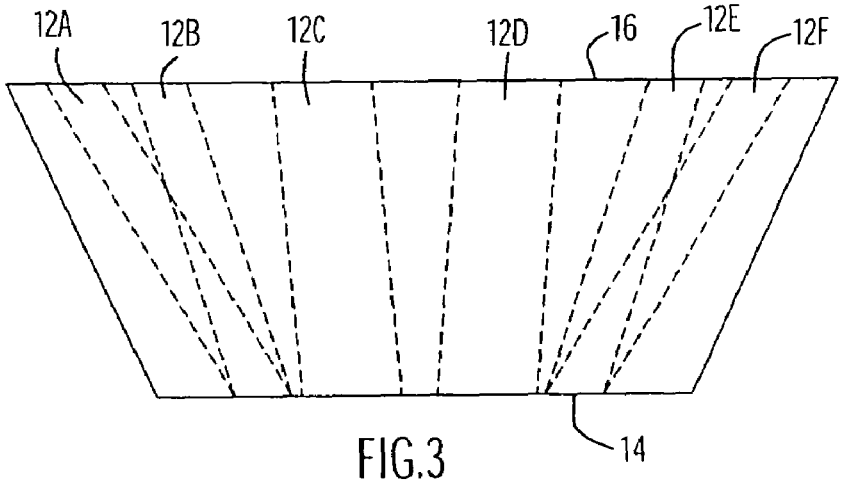
FIG. 3 is a side view in elevation and partial section of the injection lance of FIG. 1.

The orientation and cross-sectional dimensions of the injection channels within each lance 4 are depicted in FIGS. 2 and 3. Referring to FIGS. 2 and 3, each lance 4 includes a base or support block 10 constructed of a suitable material (e.g., steel and/or other metals) and has a trapezoidal cross-sectional configuration, with an outlet side 16 having a greater longitudinal dimension in comparison to an inlet side 14 of the support block. Six channels 12A, 12B, 12C, 12D, 12E and 12F, each having a circular cross-section, are disposed within and extend between the inlet and outlet sides 14, 16 of the support block 10. However, it is noted that the support block and/or injection channels may have any other suitable cross-sectional geometry (e.g., square, rectangular, elliptical or elongated, etc.).

Injection channels 12C and 12D are each oriented on a first central plane (defined by dashed line 20 in FIG. 2) projecting parallel with the inlet and outlet sides 14 and 16 of the support block 10 and dividing the support block 10 into first equal sections. Channels 12C and 12D are closest to and equally spaced from a second central plane (defined by dashed line 22 in FIG. 2) projecting perpendicular to the inlet and outlet sides 14 and 16 of the support block 10 and dividing the support block 10 into second equal sections. Channels 12C and 12D are oriented in this manner to correspond with sectors 6C and 6D of the boiler target area 2A (FIG. 1). Since sectors 6C and 6D are largest in size in comparison to the other sectors, the mass flow rates through these sectors will also be the largest and, thus, the cross-sectional dimensions of channels 12C and 12D have the largest dimensions in comparison to the other channels 12A, 12B, 12E and 12F.

Channels 12C and 12D are oriented within the support block 10 to extend away from each other and the second central plane (defined by dashed line 22 of FIG. 2) as the channels extend from the inlet side 14 to the outlet side 16. In particular, each channel 12C and 12D extends at suitable offset angle (e.g., about 5.0°) from a line extending perpendicularly between the inlet and outlet sides 14 and 16. In addition, channels 12C and 12D are suitably spaced from the center of support block 10 (e.g., the center of the outlet for each channel 12C, 12D and the second central plane, defined by dashed line 22, are separated a distance of about 0.29 inches or about 0.737 centimeters) to direct a fluid stream through the channels such that a central axis of each fluid stream (as indicated by solid lines 7C and 7D in FIG. 1) is centered between longitudinal boundaries defined by a respective sector 6C, 6D. Further, channels 12C and 12D have suitable dimensions (e.g., about 19/64 inches or about 0.754 centimeters in diameter) to facilitate a substantially uniform mass flow rate of oxygen into the respective sectors 6C and 6D when the velocity of oxygen to each injection channel is substantially similar.

Injection channels 12A and 12F are each offset a selected distance from and are on the same side of the first central plane (e.g., the center of each channel 12A, 12F is offset from the first central plane, defined by dashed line 20 in FIG. 2, a distance of about 0.18 inches or about 0.457 centimeters). Similarly, injection channels 12B and 12E are each offset a selected distance from and are on the same side of the first central plane (e.g., the center of each channel 12B, 12E is offset from the first central plane, defined by dashed line 20 in FIG. 2, a distance of about 0.18 inches or about 0.457 centimeters). Channels 12A and 12F and channels 12B and 12E are offset on opposing sides of the first central plane (defined by dashed line 20 in FIG. 2). While it is noted that the outlets of the injection channels are slightly offset from each other, the immediate expansion of the fluid streams from the respective injection channel outlets overcomes this slight offset so as to maintain fluid flow within the sectors defining the planar target area.

Channels 12A and 12F are oriented within the support block 10 to extend away from each other and the second central plane (defined by dashed line 22 of FIG. 2) as the channels extend from the inlet side 14 to the outlet side 16. In particular, each channel 12A and 12F extends at suitable offset angle (e.g., about 30.0°) from a line extending perpendicularly between the inlet and outlet sides 14 and 16. In addition, channels 12A and 12F are suitably spaced from the center of support block 10 (e.g., the center of the outlet for each channel 12A, 12F and the second central plane, defined by dashed line 22, are separated a distance of about 1.05 inches or about 2.67 centimeters) to direct a fluid stream through the channels such that a central axis of each fluid stream (as indicated by solid lines 7A and 7F in FIG. 1) is centered between longitudinal boundaries defined by a respective sector 6A, 6F. Further, channels 12A and 12F have suitable dimensions (e.g., about 11/64 inches or about 0.437 centimeters in diameter) to facilitate a substantially uniform mass flow rate of oxygen into the respective sectors 6A and 6F when the velocity of oxygen to each injection channel is substantially similar.

Channels 12B and 12E are oriented within the support block 10 to extend away from each other and the second central plane (defined by dashed line 22 of FIG. 2) as the channels extend from the inlet side 14 to the outlet side 16. In particular, each channel 12B and 12E extends at suitable offset angle (e.g., about 17.5°) from a line extending perpendicularly between the inlet and outlet sides 14 and 16. In addition, channels 12B and 12E are suitably spaced from the center of support block 10 (e.g., the center of the outlet for each channel 12B, 12E and the second central plane, defined by dashed line 22, are separated a distance of about 0.79 inches or about 2.01 centimeters) to direct a fluid stream through the channels such that a central axis of each fluid stream (as indicated by solid lines 7B and 7E in FIG. 1) is centered between longitudinal boundaries defined by a respective sector 6B, 6E. Further, channels 12B and 12E have suitable dimensions (e.g., about 11/64 inches or about 0.437 centimeters in diameter) to facilitate a substantially uniform mass flow rate of oxygen into the respective sectors 6B and 6E when the velocity of oxygen to each injection channel is substantially similar.

In operation, oxygen is injected into each of injection channels 12A–12F of lances 4 to establish a fluid flow of oxygen, preferably a substantially uniform flow of fluid, into sectors 7A–F of each target area 2A, 2B. Any one or more suitable oxygen supply sources may be connected to the inlet side 14 of the lances 4 to deliver oxygen at a single velocity to each of the injection channels. Exemplary flow rates of oxygen for the boiler system described in FIGS. 1–3 is between about 10 meters per second and about 150 meters per second. However, it is noted that larger or smaller flow rates may also be utilized, depending upon the particular system and lance design for the system.

Oxygen supplied to the injection channel inlets at the inlet side 14 of the support block 10 enters and flows through channels 12A–12F to the channel outlets, where the oxygen is then injected into the boiler and travels over each of the sectors 6A–6F along central axes 7A–7F. The dimensions of each channel 12A–12F, which are proportional to the corresponding mass flow rates calculated from equation (1), facilitates a generally uniform flow of oxygen into boiler areas 2A and 2B for mixing and reaction with fuel streams flowing within the boiler.

The lance design of FIGS. 1–3 distributes a minimal amount of oxygen required to adequately diffuse into the required area of the boiler for mixing and reaction with the combustion fuel in the boiler. The specific design of each lance, which is based upon the predefined target area of the boiler and the partitioning of the target area into sectors for individual injection channels, also ensures sufficient penetration of the injection fluid over the target area while minimizing contact with peripheral side walls of the boiler.

It is noted that the invention is not limited to boiler or other system volumes described above and depicted in FIG. 1. Rather, lances designed in accordance with the invention may be applied to system volumes having any cross-sectional geometric configuration (e.g., circular, square, irregular shaped, etc.).

Figure 4:
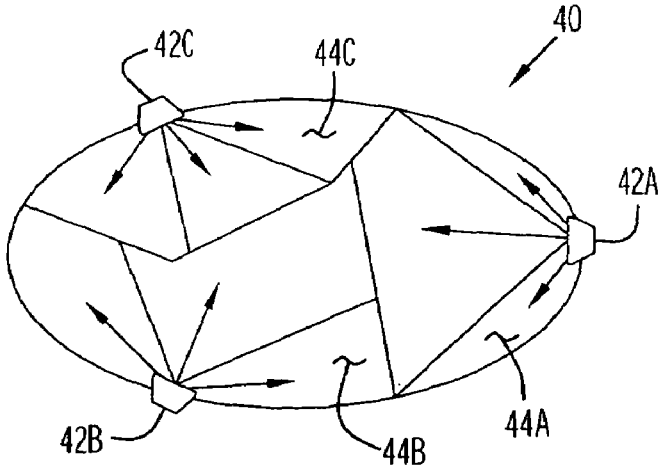
FIG. 4 is a top view in cross-section of another boiler embodiment divided into target areas, where each target area is partitioned into sectors, and further utilizing injection lances in accordance with the present invention.

In an alternative embodiment, a number of lances are utilized to achieve a uniform diffusion of a fuel into a boiler or other system having a rounded geometry. Referring to FIG. 4, a boiler 40 is schematically depicted having a rounded and generally oval geometric configuration. The boiler 40 is provided with a number of injection lances 42A, 42B and 42C configured in accordance with the present invention to uniformly distribute oxygen gas into predefined target areas for each lance. In particular, the cross-sectional area of the boiler 40 is divided into three target areas 44A, 44B and 44C for each lance, where each target area is further partitioned into three sectors. Accordingly, lances 42A–42C include three injection channels suitably aligned with the respective sectors and suitably dimensioned to provide a flow of oxygen to each sector such that the ratio of mass flow rate from each injection channel to its respective sector area is relatively constant.

It is noted that the number of lances for a boiler or other system as well as the number of injection channels per lance is not limited to what is described in the previous embodiments. Rather, any suitable number lances and injection channels per lance may be provided based upon a particular system and a target area in which a fluid is to be dispersed. For example, a single lance may contain as many as 10 or more injection channels, oriented in any suitable manner and at any suitable angles with respect to each other and the inlet and outlet side of the lance in order to satisfy the predefined sectors for the target area to be treated. Further, the outlets of the injector channels may be aligned and/or offset from each other and disposed in any suitable orientation on the outlet side of the lance. The target area within the system may be planar or non-planar (e.g., curved, convex, concave, V-shaped, saddle-shaped, zig-zagged, etc.) depending upon a particular application.

Having described novel lance devices and methods for designing lance devices for injecting fluids for uniform diffusion within a volume, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A boiler system comprising:

a boiler with an enclosed volume and a target area disposed within the enclosed volume; and a lance comprising:

a support block including an inlet side and an outlet side; and a plurality of channels disposed non-parallel with respect to each other within the support block and extending between the inlet and outlet sides so as to receive fluid at the inlet side and deliver fluid through the support block for injection from the outlet side of the support block over the target area;

wherein:

at least two channels extend from the inlet side toward the outlet side in a direction away from a central axis of the support block, the central axis intersecting the outlet side, at least two channels have different cross-sectional dimensions, the target area includes a plurality of consecutively aligned sectors, the channels are oriented within the support block such that a central axis of a fluid stream injected from each channel over the target area is centered between longitudinal boundaries defined by a respective sector, and the channels are suitably dimensioned to facilitate the flow of fluid through each channel such that the ratio of mass flow rate of fluid through each channel satisfies the following equation:

$$m_i=(A_i/A_{tot})*m_{tot};$$

wherein $m_i$ is the mass flow rate through each channel;

$A_i$ is the area of the sector for a respective channel;

$A_{tot}$ is the target area; and $m_{tot}$ is the sum of mass flow rates for each channel.

2. The boiler system of claim 1, further comprising:

a fuel inlet to facilitate injection of a fuel stream into the boiler volume that intersects the target area.

* * * * *